US006852364B2

(12) United States Patent
Schmitt et al.

(10) Patent No.: US 6,852,364 B2
(45) Date of Patent: Feb. 8, 2005

(54) COATING METHOD USING HOLLOW CHUCK HEAD

(75) Inventors: Peter J. Schmitt, Williamson, NY (US); Dante M. Pietrantoni, Rochester, NY (US); Magda M. Alvarez-Estrada, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/409,776

(22) Filed: Apr. 8, 2003

(65) Prior Publication Data

US 2004/0202791 A1 Oct. 14, 2004

(51) Int. Cl.[7] ..... B05D 1/18

(52) U.S. Cl. ..... 427/282; 427/430.1; 118/423; 118/428; 118/500; 118/505

(58) Field of Search ..... 118/423, 428, 118/500, 505; 427/430.1, 282; 279/2.17, 2.1; 269/48.1

(56) References Cited

U.S. PATENT DOCUMENTS 5,186,477 A * 2/1993 Nakazawa et al. ..... 279/2.09
5,282,888 A * 2/1994 Fukawa et al. ..... 118/500
5,683,755 A 11/1997 Godlove et al. ..... 427/430.1
5,688,327 A 11/1997 Swain et al. ..... 118/500
5,743,538 A 4/1998 Schmitt et al. ..... 279/2.17
5,853,813 A 12/1998 Chambers et al. ..... 427/430.1
6,132,810 A 10/2000 Swain et al. ..... 427/430.1
2002/0040681 A1 * 4/2002 Furuya et al. ..... 118/502

OTHER PUBLICATIONS

Thomas et al., "Coating Method Using Chuck With Air Chamber", U.S. Appl. No. 10/409,777, (D/A2117) filed concurrently herewith.

* cited by examiner

*Primary Examiner*—Katherine Bareford
(74) *Attorney, Agent, or Firm*—Zosan S. Soono

(57) ABSTRACT

A method for dip coating the exterior surface of a hollow substrate having an open first end and an open second end, the method including:

(a) inserting a chuck assembly through the open first end into the substrate interior, wherein the chuck assembly includes a head section and a polymeric member and defines a space that communicates with the substrate interior but is otherwise enclosed, wherein the space is located in the head section;

(b) holding the substrate with the chuck assembly wherein the polymeric member forms a hermetic seal with the substrate;

(c) contacting the substrate with a coating solution, starting from the second end, while the chuck assembly holds the substrate and the hermetic seal is maintained between the polymeric member and the substrate, wherein there is a closed area into which vapor from the coating solution can flow and the closed area is defined by the space of the chuck assembly and the substrate interior; and (d) separating the substrate and the coating solution to leave a layer of the coating solution on the exterior surface of the substrate.

12 Claims, 4 Drawing Sheets

COATING METHOD USING HOLLOW CHUCK HEAD

BACKGROUND OF THE INVENTION

During dip coating of a substrate in for example a photosensitive coating solution, "burping" may occur when the coating solution contains a volatile solvent. This is because the volatile solvent evaporates from the coating solution and is trapped within the confines of the substrate interior, resulting in a pressure buildup. The resulting increase in pressure may cause a gas (typically air) to escape from inside the substrate shortly before it emerges from the coating solution. This escape of the gas typically causes a solution surface disturbance which may result in a nonuniform coating thickness on the substrate. There is a need, which the present invention addresses, for new methods and chuck assemblies to minimize or eliminate the "burping" phenomenon.

Conventional dip coating methods and chuck assemblies are described in the following:

Schmitt et al., U.S. Pat. No. 5,743,538;

Chambers et al., U.S. Pat. No. 5,853,813;

Godlove et al., U.S. Pat. No. 5,683,755;

Swain et al., U.S. Pat. No. 5,688,327; and

Swain et al., U.S. Pat. No. 6,132,810.

SUMMARY OF THE INVENTION

The present invention is accomplished in embodiments by providing a method for dip coating the exterior surface of a hollow substrate having an open first end and an open second end, the method comprising:

(a) inserting a chuck assembly through the open first end into the substrate interior, wherein the chuck assembly includes a head section and a polymeric member and defines a space that communicates with the substrate interior but is otherwise enclosed, wherein the space is located in the head section;

(b) holding the substrate with the chuck assembly wherein the polymeric member forms a hermetic seal with the substrate;

(c) contacting the substrate with a coating solution, starting from the second end, while the chuck assembly holds the substrate and the hermetic seal is maintained between the polymeric member and the substrate, wherein there is a closed area into which vapor from the coating solution can flow and the closed area is defined by the space of the chuck assembly and the substrate interior; and (d) separating the substrate and the coating solution to leave a layer of the coating solution on the exterior surface of the substrate.

BRIEF DESCRIPTION OF THE DRAWINGS

Other aspects of the present invention will become apparent as the following description proceeds and upon reference to the Figures which represent exemplary embodiments.

Unless otherwise noted, the same reference numeral in different Figures refers to the same or similar feature.

DETAILED DESCRIPTION

As used herein, the term "coating solution" refers to any liquid composition useful for dip coating regardless of the extent that materials are dissolved in the liquid medium.

Figure 1:
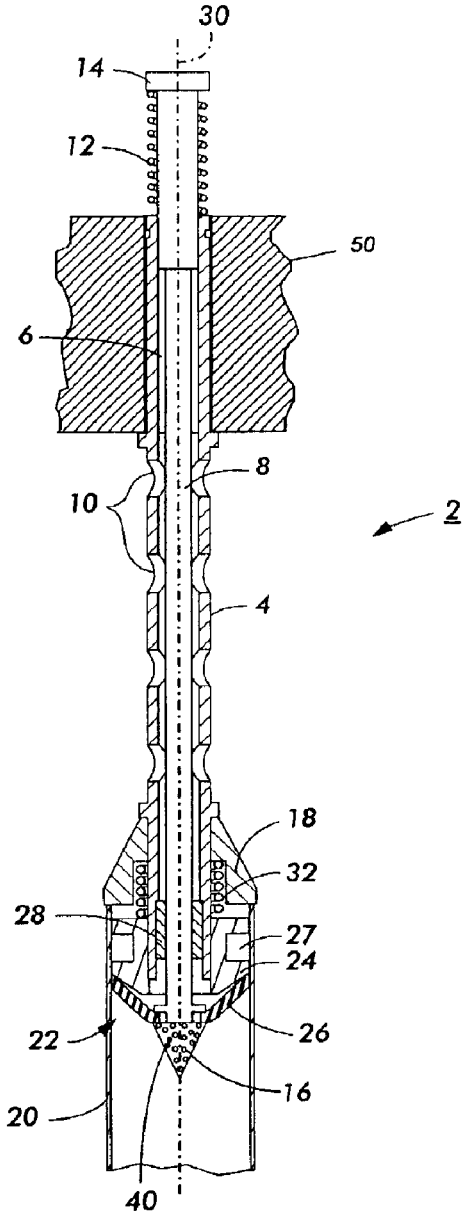
FIG. 1 represents an elevational view in partial cross-section of a first embodiment of the present chuck assembly.
Figure 2:
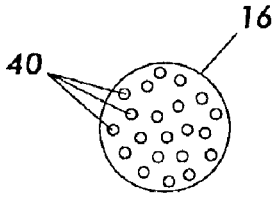
FIG. 2 represents an end view of the chuck assembly of FIG. 1.
Figure 3:
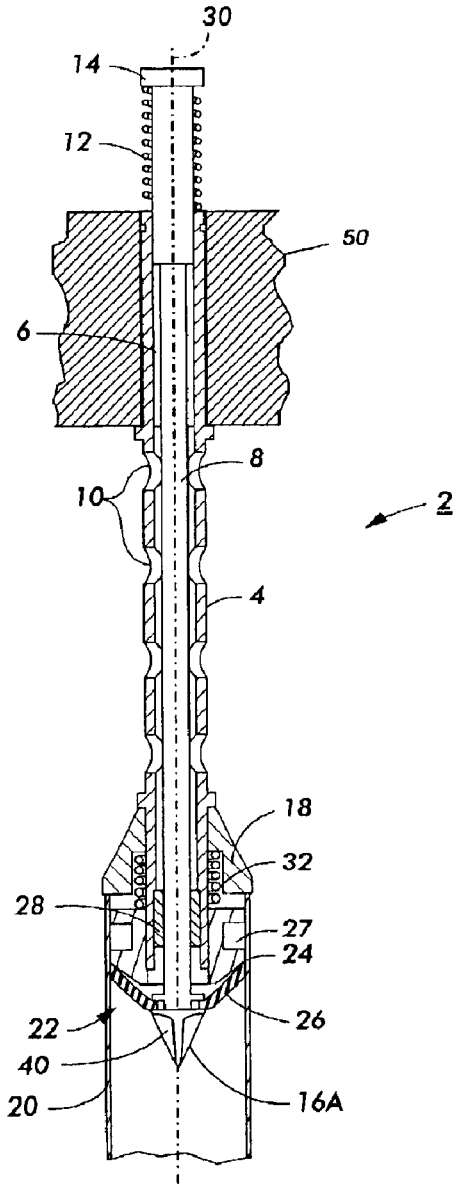
FIG. 3 represents an elevational view in partial cross-section of a second embodiment of the present chuck assembly.
Figure 4:
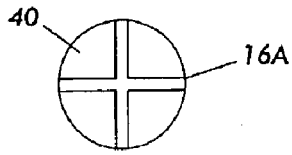
FIG. 4 represents an end view of the chuck assembly of FIG. 3.
Figure 5:
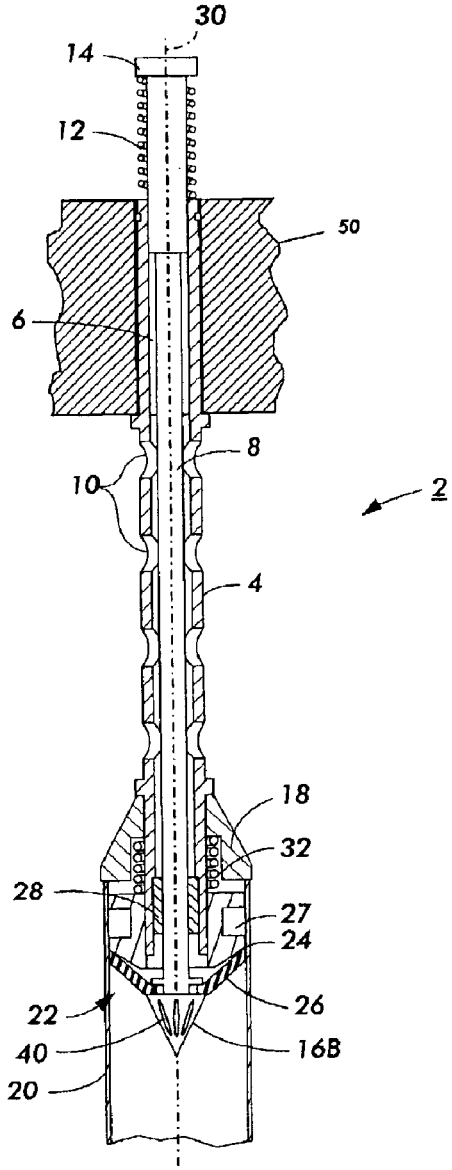
FIG. 5 represents an elevational view in partial cross-section of a third embodiment of the present chuck assembly.
Figure 6:
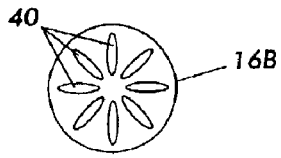
FIG. 6 represents an end view of the chuck assembly of FIG. 5.

The present method may be accomplished with any suitable chuck assembly. FIG. 1 depicts an exemplary chuck assembly 2 including a body 4 defining a passageway 6, a width changing apparatus 8 in the form of for example a vertically moveable rod disposed in the passageway along the length of the body. The body may define a plurality of holes 10 to reduce weight. The width changing apparatus 8 is spring loaded via a spring 12 and a top cap 14. A head section 16 is coupled to one end of the width changing apparatus. The body 4 includes an alignment shoulder 18 which serves to act as a stop for a substrate 20. The end portion 22 includes a wedge 24 and a polymeric member 26 that has a changeable width. The polymeric member is coupled, via a recess machined into the head section, to the width changing apparatus 8 and rests against the wedge 24. The wedge defines a groove 27 (the purpose of the groove 27 is for mass reduction) and is operatively coupled to a spring 32 which may be a flat spring. A bushing 28 positions the width changing apparatus 8 within the end portion 22. The alignment shoulder 18 and the end portion 22 are positioned on the longitudinal axis 30 of the chuck assembly, where the alignment shoulder is positioned above the end portion. A chuck positioning apparatus 50 is coupled to the chuck assembly 2 for moving the chuck assembly and the engaged substrate during the dip coating method.

FIGS. 1–7 depict various embodiments of the chuck assembly where the head section (16, 16A, 16B, 16C) defines a space 40. The space 40 refers collectively to any and all surface opening(s) and chamber(s) in the head section. The head section may be hollow with at least one surface opening (or a plurality of surface openings) to allow the flow of vapor from the coating solution into the head section. The surface opening or openings may be of any suitable shape and size. In embodiments, the head section is hollow, but in other embodiments it may be only partially hollow. The head section may be of any suitable size and shape, having for example parallel surfaces, curved surfaces, or inclined surfaces. In embodiments, the head section is cone shaped to facilitate insertion of the chuck assembly into the substrate. In embodiments, the space defined by the head section ranges from about 20% to about 90% of the volume of the head section.

The present invention may be advantageous in embodiments. The presence of space 40 in the head section increases the volume of the closed area, i.e., the trapped air volume within the substrate interior between the coating solution and the chuck assembly. Such an increased volume of the closed area decreases the buildup of pressure caused by vapor (e.g., solvent evaporation) from the coating solution, thereby reducing the occurrence of the "burping" phenomenon. In addition, the space 40 reduces the thermal mass of the chuck assembly. To produce uniform coatings it is advantageous for the substrate to have uniform temperature profiles throughout all the processing steps. Since the chuck assembly acts as a heat sink it is desirable to minimize the thermal mass of the chuck assembly thus reducing its effect on temperature uniformity. Additionally this reduction of thermal mass will reduce the transfer of heat to the entrapped gas, which will reduce the gas expansion (burping).

Operation of the chuck assembly depicted in FIG. 1 proceeds as follows. The width changing apparatus 8 is depressed downwards via pressure on top cap 14, which moves the polymeric member 26 downwards away from the alignment shoulder 18 along the longitudinal axis 30, which stretches the polymeric member downwards, and which may lift a part of the polymeric member slightly off the wedge 24, thereby decreasing the width of the polymeric member. In embodiments, the entire polymeric member can move down and then up along the longitudinal axis. During the movement of the polymeric member downwards, the spring 32 also pushes the wedge downwards away from the alignment shoulder. When the width of the polymeric member is decreased, the end portion 22 may be inserted into the substrate 20. When the end of the substrate is close to or at the alignment shoulder, the pressure on the end cap is reduced or eliminated and the width changing apparatus 8 moves upward. Upward movement of the width changing apparatus in the direction of the alignment shoulder reduces the downward force on the polymeric member which increases the width of the polymeric member, allows engagement of the edge of the polymeric member with the substrate inner surface, and pulls the substrate towards the alignment shoulder due to the upward movement of the polymeric member and the wedge towards the alignment shoulder. The engagement of the polymeric member with the substrate inner surface and the pulling up of the substrate by the upward movement of the engaged polymeric member may occur substantially simultaneously. After processing of the substrate, the width changing apparatus is depressed to shrink the width of the polymeric member, thereby allowing withdrawal of the chuck assembly from the substrate.

Thus, in embodiments, the end portion is moveable from an initial position adjacent the alignment shoulder to a position spaced apart from the alignment shoulder and back to like initial position adjacent the alignment shoulder. In embodiments, the polymeric member is adapted to move for a length ranging for example from about 3 mm to about 2 cm along the longitudinal axis. The polymeric member pulls the substrate along the longitudinal axis for a distance ranging for example from about 3 mm to about 2 cm towards the alignment shoulder. Preferably, the pulling action of the polymeric member on the substrate seats the end of the substrate against the alignment shoulder. In embodiments, the chuck assembly can pull up the substrate even when the other end of the substrate is unsupported.

During engagement of the chuck assembly with the substrate, it is preferred that a hermetic seal is created by contact of the polymeric member against the substrate inner surface to minimize or prevent fluid migration, especially liquid, into the interior of the substrate.

Figure 7:
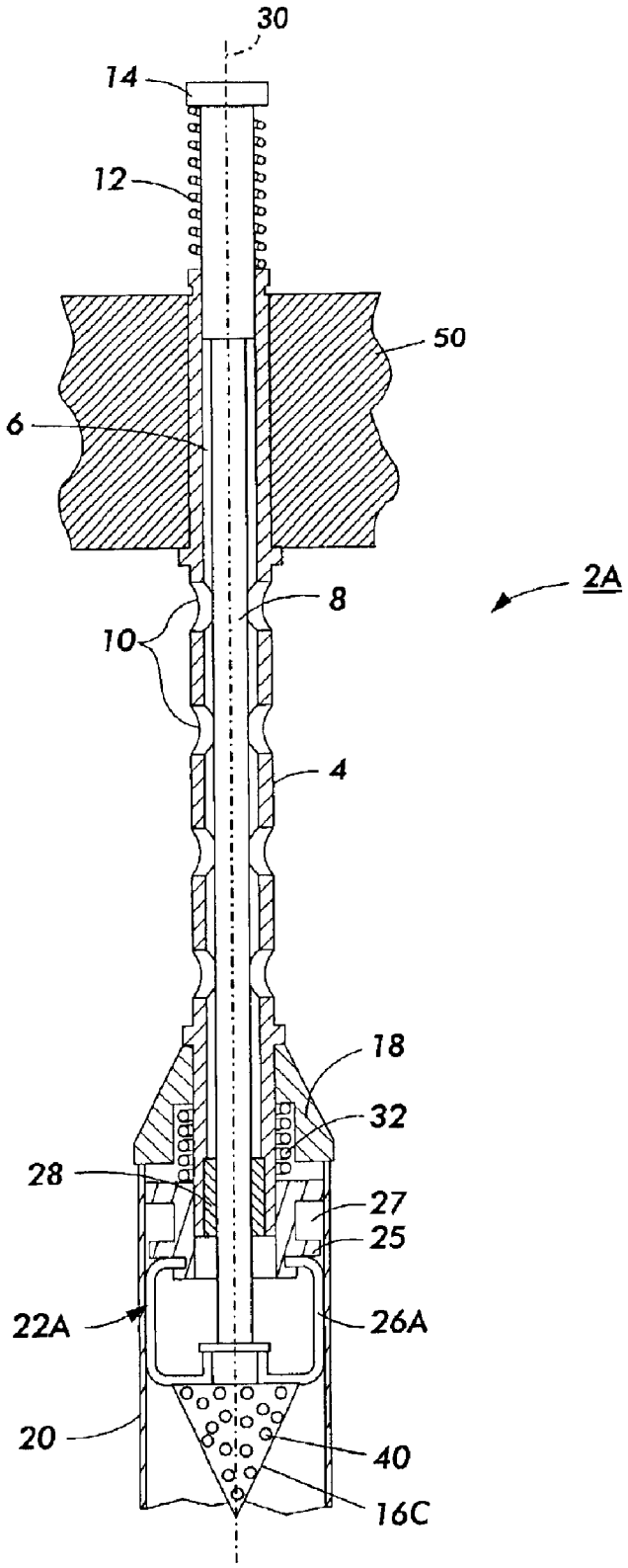
FIG. 7 represents an elevational view in partial cross-section of a fourth embodiment of the present chuck assembly.

An alternative chuck assembly 2A is disclosed in FIG. 7 where the chuck assembly 2A is similar to the chuck assembly 2 of FIG. 1 except the polymeric member 26A has a donut shaped configuration, a compression flange 25 replaces the wedge 24, and head section 16C has a different shape than head section 16. The compression flange 25 has a recess machined in its lower section to capture the polymeric member 26A. Operation of this alternative chuck assembly of FIG. 7 proceeds in a similar manner to the embodiment of FIG. 1 described herein where the width changing apparatus 8 is depressed downwards via pressure on top cap 14, which moves the polymeric member 26A downwards away from the alignment shoulder 18 along the longitudinal axis 30, which stretches the polymeric member downwards, thereby decreasing the width of the polymeric member. In embodiments, the entire polymeric member can move down and then up along the longitudinal axis. During the movement of the polymeric member downwards, the spring 32 also pushes the compression flange downwards away from the alignment shoulder. When the width of the polymeric member is decreased, the end portion 22A (composed of polymeric member 26A and compression flange 25) may be inserted into the substrate 20. When the end of the substrate is close to or at the alignment shoulder, the pressure on the end cap is reduced or eliminated and the width changing apparatus 8 moves upward. Upward movement of the width changing apparatus in the direction of the alignment shoulder pushes the polymeric member against the compression flange which increases the width of the polymeric member, allows engagement of the edge of the polymeric member with the substrate inner surface, and pulls the substrate towards the alignment shoulder due to the upward movement of the polymeric member and the compression flange towards the alignment shoulder. The engagement of the polymeric member with the substrate inner surface and the pulling up of the substrate by the upward movement of the engaged polymeric member may occur substantially simultaneously. After processing of the substrate, the width changing apparatus is depressed to shrink the width of the polymeric member, thereby allowing withdrawal of the chuck assembly from the substrate.

In FIGS. 1 and 7, the polymeric member is depicted as contacting the head section. In other embodiments, the polymeric member does not contact the head section where the polymeric member may be for example spaced from the head section or there may be another component intermediate between the polymeric member and the head section.

The polymeric member may be elastic and may be fabricated from any suitable material including for instance silicone, such as silicone rubber compound no. 88201 available from Garlock Corporation, and flexible/elastic high temperature elastomers such as VITON™ and ZETPOL 2000™ (hydrogenated nitrile elastomer—HNBr). The polymeric member may be coned shaped or donut shaped and may have a wall thickness ranging for example from about 1 mm to about 5 mm. There is a hole in the polymeric member to accommodate the width changing apparatus.

The other components of the chuck assembly may be fabricated from any suitable material. For example, the head section, the body and the width changing apparatus may be fabricated from a plastic or a metal like steel or aluminum. The wedge and the compression flange may be made of a plastic such as TEFLON™.

The phrase "dip coating" encompasses the following techniques to deposit layered material onto a substrate: moving the substrate into and out of the coating solution; raising and lowering the coating vessel to contact the solution with the substrate; and while the substrate is positioned in the coating vessel filling the vessel with the solution and then draining the solution from the vessel. The substrate may be moved into and out of the solution at any suitable speed including the takeup speed indicated in Yashiki et al., U.S. Pat. No. 4,610,942, the disclosure of which is hereby totally incorporated by reference. The dipping speed may range for example from about 50 to about 1500 mm/min and may be a constant or changing value. The takeup speed during the raising of the substrate may range for example from about 50 to about 500 mm/min and may be a constant or changing value. In one embodiment, the takeup speed is the same or different constant value for all the dip coating steps of the present invention. In embodiments, all the substrates in a batch are dip coated substantially simultaneously, preferably simultaneously, in each coating solution. Exemplary equipment to control the speed of the substrate during dip coating is available from Allen-Bradley Corporation and involves a programmable logic controller with an intelligent motion controller. With the exception of the wet coating solution bead which may be at the bottom edge of the substrate, the thickness of each wet coated layer on the substrate may be relatively uniform and may be for example from about 1 to about 60 micrometers in thickness. Each coated layer when dried may have a thickness ranging for example from about 0.001 to about 60 micrometers.

Any suitable rigid or flexible substrate may be held by the present chuck assembly. The substrate may have a cylindrical cross-sectional shape or a noncylindrical cross-sectional shape such as an oval shape. The substrate may be hollow with both ends being open. In embodiments, the substrate is used in the fabrication of photoreceptors. The substrate may have any suitable dimensions.

Between dip coating steps, a part of the solvent from the wet coated layer may be removed by exposure to ambient air (i.e., evaporation process) for a period of time ranging for example from about 1 to about 50 minutes, or from about 5 to about 30 minutes. Thus, in embodiments, the present method removes a portion of the wetness from an earlier deposited layer prior to depositing another layer on top of the earlier deposited layer. The coated layer is sufficiently dry with no fear of contamination of the next coating solution when gentle rubbing with a finger or cloth fails to remove any of the coated layer.

Any suitable coating solution may be used, particularly those useful in dip coating. In embodiments, the coating solution may comprise materials typically used for any layer of a photosensitive member including such layers as a charge barrier layer, an adhesive layer, a charge transport layer, a charge generating layer, and an overcoat layer, such materials and amounts thereof being illustrated for instance in U.S. Pat. Nos. 4,265,990, 4,390,611, 4,551,404, 4,588,667, 4,596,754, and 4,797,337, the disclosures of which are totally incorporated by reference.

In embodiments, a coating solution may include the materials for a charge barrier layer including for example polymers such as polyvinylbutyral, epoxy resins, polyesters, polysiloxanes, polyamides, or polyurethanes. Materials for the charge barrier layer are disclosed in U.S. Pat. Nos. 5,244,762 and 4,988,597, the disclosures of which are totally incorporated by reference.

The optional adhesive layer preferably has a dry thickness between about 0.001 micrometer to about 0.2 micrometer. A typical adhesive layer includes film-forming polymers such as polyester, du Pont 49,000 resin (available from E. I. du Pont de Nemours & Co.). VITEL-PE100™ (available from Goodyear Rubber & Tire Co.), polyvinylbutyral, polyvinylpyrrolidone, polyurethane, polymethyl methacrylate, and the like. In embodiments, the same material can function as an adhesive layer and as a charge blocking layer.

In embodiments, a charge generating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. A representative charge generating solution comprises: 2% by weight hydroxy gallium phthalocyanine; 1% by weight terpolymer of vinyl acetate, vinyl chloride, and maleic acid; and 97% by weight cyclohexanone.

In embodiments, a charge transport solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. An illustrative charge transport solution has the following composition: 10% by weight N,N'-diphenyl-N,N'-bis(3-methylphenyl)-(1,1'-biphenyl)-4,4'diamine; 14% by weight poly(4,4'-diphenyl-1,1'-cyclohexane carbonate) (400 molecular weight); 57% by weight tetrahydrofuran; and 19% by weight monochlorobenzene.

A coating solution may also contain a solvent, preferably an organic solvent, such as one or more of the following: tetrahydrofuran, monochlorobenzene, and cyclohexanone.

After each layer is coated onto the substrate or after all the desired layers are coated onto the substrate, the layer(s) may be subjected to elevated drying temperatures such as from about 100 to about 200° C. for about 0.2 to about 2 hours.

In one embodiment of the present method, a layer of the charge generating solution is applied prior to deposition of a layer of the charge transport solution. Where an optional undercoat layer (e.g., an adhesive layer or a charge blocking layer) is desired, the undercoat layer is applied first to the substrate, prior to the deposition of any other layer.

We claim:

1. A method for dip coating the exterior surface of a hollow substrate having an open first end and an open second end, the method comprising:

(a) inserting a chuck assembly through the open first end into the substrate interior, wherein the chuck assembly includes a head section and a polymeric member and defines a space that communicates with the substrate interior but is otherwise enclosed, wherein the space is located in the head section and the space is entirely disposed within the substrate interior;

(b) holding the substrate with the chuck assembly wherein the polymeric member forms a hermetic seal with the substrate;

(c) contacting the substrate with a coating solution, starting from the second end, while the chuck assembly holds the substrate and the hermetic seal is maintained between the polymeric member and the substrate, wherein there is a closed area into which vapor from the coating solution can flow and the closed area is defined by the space of the chuck assembly and the substrate interior; and (d) separating the substrate and the coating solution to leave a layer of the coating solution on the exterior surface of the substrate.

2. The method of claim 1, wherein the coating solution is a charge transport solution.

3. The method of claim 1, wherein the coating solution is a charge generating solution.

4. The method of claim 1, wherein the head section is cone shaped.

5. The method of claim 1, wherein the space is defined by a hollow head section that includes at least one surface opening to allow flow of vapor from the coating solution into the hollow head section.

6. The method of claim 1, wherein the space is defined by a hollow head section that includes a plurality of surface openings to allow flow of vapor from the coating solution into the hollow head section.

7. The method of claim 1, wherein the polymeric member contacts the head section.

8. The method of claim 1, further comprising drying at an elevated temperature the layer of the coating solution.

9. The method of claim 1, wherein the layer of the coating solution has a dry thickness ranging from about 0.001 to about 60 micrometers.

10. The method of claim 1, wherein the separating the substrate and the coating solution is accomplished at a takeup speed ranging from about 50 to about 500 mm/min.

11. The method of claim 1, wherein the space defined by the head section ranges from about 20% to about 90% of the volume of the head section.

12. The method of claim 1, wherein the polymeric member is elastic.

* * * * *